US007633374B2

(12) United States Patent
Kirsten

(10) Patent No.: US 7,633,374 B2
(45) Date of Patent: Dec. 15, 2009

(54) POSITIVE TEMPERATURE COEFFICIENT (PTC) COMPONENT AND METHOD FOR THE PRODUCTION THEREOF

(75) Inventor: Lutz Kirsten, Deutschlandsberg (AT)

(73) Assignee: Epcos AG, Munich (DE)

( * ) Notice: Subject to any disclaimer, the term of this patent is extended or adjusted under 35 U.S.C. 154(b) by 329 days.

(21) Appl. No.: 10/511,820

(22) PCT Filed: Apr. 14, 2003

(86) PCT No.: PCT/DE03/01264

§ 371 (c)(1),
(2), (4) Date: Jun. 27, 2005

(87) PCT Pub. No.: WO03/092019

PCT Pub. Date: Nov. 6, 2003

(65) Prior Publication Data

US 2006/0132280 A1 Jun. 22, 2006

(30) Foreign Application Priority Data

Apr. 23, 2002 (DE) ..... 102 18 154

(51) Int. Cl.
*H01C 7/18* (2006.01)

(52) U.S. Cl. ..... 338/204; 252/62.3 T

(58) Field of Classification Search ..... 338/204
See application file for complete search history.

(56) References Cited

U.S. PATENT DOCUMENTS 3,533,966 A * 10/1970 Moratis ..... 264/616
4,254,070 A 3/1981 Yodogawa et al.
4,425,556 A 1/1984 Hanke et al.
5,879,812 A 3/1999 Nishiyama et al.
6,320,738 B1 11/2001 Yamana et al.
6,522,237 B1 * 2/2003 Ito et al. ..... 338/22 R
6,898,071 B2 5/2005 Kirsten
6,911,893 B2 * 6/2005 Kodama et al. ..... 338/22 R
7,154,736 B2 12/2006 Kirsten
2004/0121179 A1 6/2004 Kirsten

FOREIGN PATENT DOCUMENTS

DE 29 44 029 4/1988

(Continued)

OTHER PUBLICATIONS

Examination Report for corresponding application No. 03747078.8 dated Mar. 22, 2007.

(Continued)

*Primary Examiner*—Elvin G Enad
*Assistant Examiner*—Joselito Baisa
(74) *Attorney, Agent, or Firm*—Fish & Richardson P.C.

(57) ABSTRACT

An electrical component includes a base made of ceramic layers and electrode layers, where the electrode layers separate adjacent ceramic layers, and the ceramic layers include a ceramic material that has a positive temperature coefficient in at least one part of an R/T characteristic curve. The component includes a first collector electrode attached to a first side of the electrical component and a second collector electrode attached to a second side of the electrical component, such that first collector electrode and the second collector electrode contact alternate electrode layers. The electrical component has a volume V and a resistance R, where the resistance R is measured between collector electrodes at a temperature of between 0° C. and 40° C., and $V \cdot R < 600\Omega \cdot mm^3$.

14 Claims, 6 Drawing Sheets

FOREIGN PATENT DOCUMENTS

| | | |
|---|---|---|
| DE | 196 22 690 | 12/1996 |
| DE | 197 19 174 | 11/1998 |
| DE | 100 53 769 | 5/2001 |
| DE | 100 18 377 | 12/2001 |
| DE | 101 20 517 | 11/2002 |
| EP | 0 040 391 | 11/1981 |
| EP | 0 974 982 | 1/2000 |
| GB | 1186116 | 4/1970 |
| JP | 55-88304 | 7/1980 |
| JP | 57-60802 | 4/1983 |
| JP | 01-186601 | 7/1989 |
| JP | 01-233702 | 9/1989 |
| JP | 05-047508 | 2/1993 |
| JP | 06-302403 | 10/1994 |
| JP | 2004-521508 | 7/2004 |
| JP | 2004-521510 | 7/2004 |
| WO | WO02/089160 | 11/2002 |
| WO | WO02/091408 | 11/2002 |
| WO | WO03/090219 | 10/2003 |
| WO | WO03/092019 | 11/2003 |

OTHER PUBLICATIONS

Muller & Schubert communication for corresponding application No. 03747078.8 dated Mar. 13, 2007.

Examination report from corresponding Japanese application dated Mar. 17, 2008.

Examination report from corresponding Application No. EP03747078.8, dated Mar. 17, 2008.

* cited by examiner

POSITIVE TEMPERATURE COEFFICIENT (PTC) COMPONENT AND METHOD FOR THE PRODUCTION THEREOF

TECHNICAL FIELD

This patent application relates to a PTC component as well as to a method for production of the component.

BACKGROUND

For ceramic PTC resistors, which include components having a resistor with a positive temperature coefficient or so-called PTC elements, no conventionally used, temperature-stable electrodes manufactured of precious metal are suitable. These cannot form resistive contact between the ceramic material and the metallic electrodes. Therefore, PTC elements with (internal) electrodes manufactured of precious metal have an inordinately high resistance. The non-precious metals suitable for electrode material, however, generally do not withstand the sintering process that is necessary for the construction of multi-layer components.

From the publication. DE 19719174 A1, a ceramic PTC resistor in multi-layer design equipped with electrode layers containing aluminum is known to the art. These layers form a resistive contact with the ceramic material and can be sintered at temperatures of up to 1200° without incurring damage. The disadvantage in this multi-layer PTC component, however, is the fact that the aluminum partially diffuses from the electrode layers into the ceramic material, thereby impairing the component properties in the medium or long term or even making the component unusable.

From the publication DE 100 18 377 C1, a PTC component is known to the art that is a multi-layer component consisting of stacked ceramic layers and which is sintered or re-tempered in an atmosphere with high oxygen content. The PTC component contains, internal electrodes with tungsten. Tungsten does withstand the sintering process.

However, sintering or subsequent tempering at high oxygen partial pressure entails the danger of the oxidation of the internal electrodes, which results in PTC components with high resistance; this is not desirable.

Sintering in an oxygenic atmosphere, on the other hand, is necessary in order to form the grain boundary-active layers of the PTC ceramic material (on the basis of doped $BaTiO_3$) during the cooling process. This results in the situation that at a certain temperature the resistance of the ceramic material increases erratically, depending on the precise composition of the ceramic material.

SUMMARY

Described herein is a method for the manufacture of a PTC component with the following steps:

a) Production of a stack of layers composed of ceramic green sheets with interposed electrode layers;

b) Removal of binders from and sintering of the stack of layers in an atmosphere with lowered oxygen content in relation to air.

A PTC component includes a component with a base body comprising stacked ceramic layers separated from one another by electrode layers. The ceramic layers contain a ceramic material that has a positive temperature coefficient in at least one part of the R/T characteristic line.

Furthermore, the component is equipped with laterally attached collector electrodes. The electrode layers are contacted alternately with these collector electrodes.

Due to the fact that binder removal as well as sintering are performed in an atmosphere with low oxygen content, an oxidation of the metals contained in the internal electrodes can be inhibited, which then permits the production of PTC components with improved properties.

In this context, it is advantageous if the oxygen content is lowered further during sintering, when generally higher temperatures are used than for debindering.

In particular, the method permits the production of PTC components with a volume V and a resistance R that is measured between the collector electrodes at a temperature of between 0° C. and 40° C., while $V \cdot R < 600$.

The production of PTC components that have simultaneously a small volume and a low resistance is thus possible, which is desirable in view of the continuing miniaturization of PTC-specific applications.

It has become evident that electrodes comprised of tungsten or containing tungsten withstand the sintering process necessary for the ceramic component while simultaneously forming a good resistive contact with the ceramic material. During sintering, only small, if any, processes of tungsten diffusion into the ceramic material, which might impair the ceramic component properties, are observed. At the same time, tungsten has an electrical conductivity that is comparable to that of precious metals and for pure tungsten, is three times as high as that of silver, so that electrode layers with a sufficient electrical load rating can already be achieved with thinner tungsten layers. In addition, tungsten represents an economical electrode material that, for example, is substantially more economical than precious metals such as palladium or platinum.

The component, and the method for the manufacture of the component, is explained below in more detail with reference to exemplary embodiments and the respective figures. The figures serve only for illustration; they are only schematic representations and not to scale.

DETAILED DESCRIPTION

In order to manufacture ceramic green sheets, the ceramic base material is finely ground and mixed with a binder material to produce a homogeneous mixture. The sheet is subsequently manufactured in a desired thickness by drawing or casting.

Figure 1:
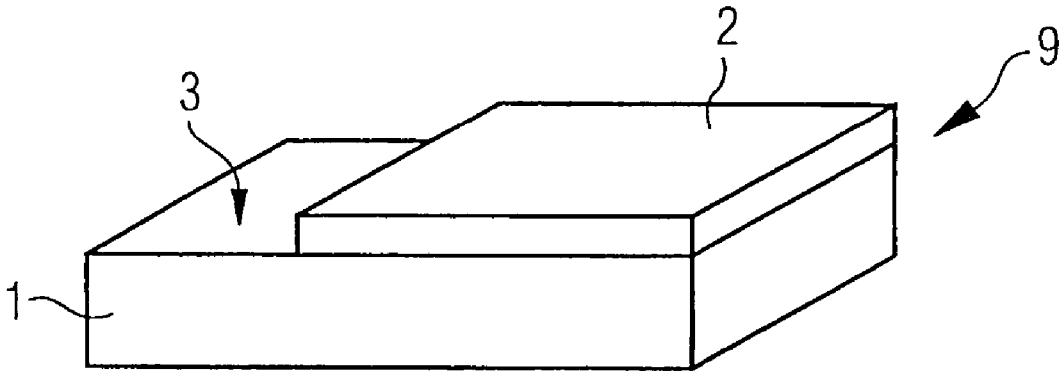
FIG. 1 shows a ceramic green sheet imprinted with an electrode layer in a perspective view.

FIG. 1 shows a green sheet 1 of this type in a perspective view. Then, an electrode paste 2 is applied onto a surface of the green sheet 1 in the area provided for the electrode.

A series of processes, in particular thick layer processes, such as imprinting, for example screen printing, are suitable for this process. A surface area not covered by electrode paste and here called passive area 3 remains, at least in the area of an edge of the green sheet 1, such as for example is shown in FIG. 1, or just in the area of one corner of the green sheet. It is also possible to apply the electrode not as a flat, but rather as a structured layer, if necessary, in an open-worked pattern.

The electrode paste 2 comprises metallic particles containing metallic tungsten or a tungsten compound for the purpose of generating the desired conductivity, ceramic particles, if necessary, which can be sintered for the purpose of adapting the shrinkage properties of the electrode paste to the ceramic material, and an organic binder, which can be burnt out for the purpose of ensuring the formability of the ceramic compound or the cohesion of the green bodies respectively. Here, particles of pure tungsten, particles of a tungsten alloy, a tungsten compound, or mixed particles of tungsten and other metals may be used. The electrode layers and thus the electrode paste can also contain additional tungsten compounds, such as tungsten carbide, tungsten nitride, or tungsten oxide (WO). A decisive factor is that the tungsten be present in an oxidation stage less than +6, so that it will still be able to perform its function for the decomposition of the barrier layer.

With ceramic multi-layer components subject to only low mechanical stress, it is also possible to do completely without the ceramic content in the electrode paste. The tungsten content can vary within a large range, while, if necessary, the sintering conditions may have to be adapted to the composition of the electrode paste. The decomposition of the barrier layer for PTC resistor materials is achieved on a regular basis with a tungsten content of 3 and more weight percent (with reference to the metallic particles).

Subsequently, the printed green sheets 9 are stacked in a desired number to form a stack of sheets in such a way that (green) ceramic layers 1 and electrode layers 2 are stacked alternately one on the other.

During subsequent contacting, the electrode layers are, in addition, linked to collector electrodes alternately on different sides of the component, in order to connect the individual electrodes in parallel. In this process, it is advantageous to stack first and second green sheets 9 in such a way that the imprinted electrode layers 2 have a differing orientation so that the passive areas 3 thereof point alternately in different directions. A uniform electrode geometry is may be chosen for this. First and second green sheets 9 differ in that they are rotated at an angle of 180° in relation to one another within the stack of sheets. However, it is also possible to select a base size of greater symmetry for the component in order to make rotation by other angles than 180° possible, for example 90° when providing a square base, with the intention of achieving alternating contacting. However, it is also possible to offset the electrode pattern for every other green sheet 9 by a certain amount in relation to that of the first green sheets in such a way that each passive area 3 is located in the respective adjacent green sheet over an area imprinted with electrode paste.

Subsequently, the stack of sheets, which thanks to the binder is still flexibly resilient is brought into the desired outer form by compression and, if necessary, by cutting. The stack of sheets is then freed of the binder and sintered, either separately or in one single step.

Figure 2:
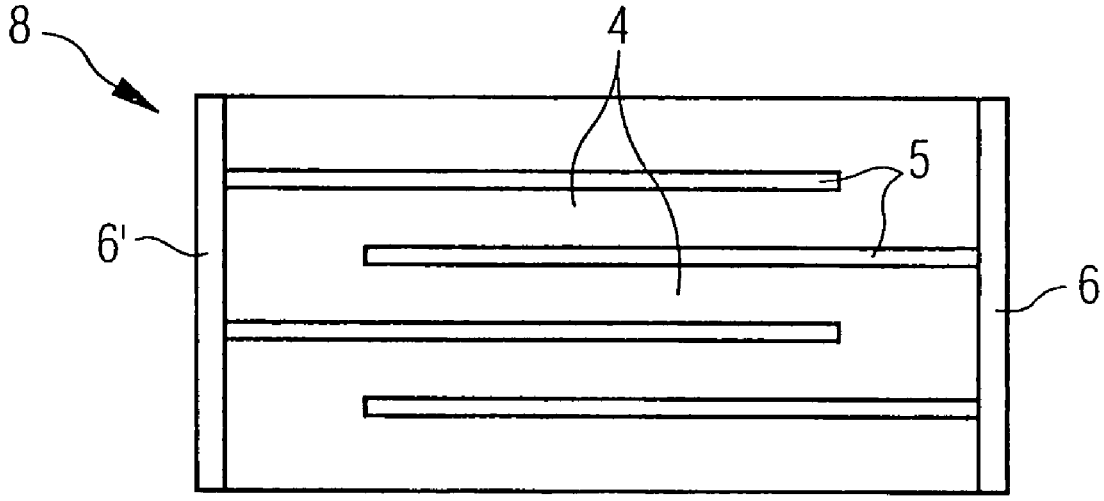
FIG. 2 shows a schematic cross section of the multi-layer component.

After sintering, the individual green sheet layers develop into a monolithic ceramic component body 8, in which the individual ceramic layers 4 are firmly bonded. This firm bonding also exists at the connecting areas between ceramic material/electrode/ceramic material. FIG. 2 shows a schematic cross section of a finished multi-layer component 8. Ceramic layers 4 and electrode layers 5 are alternately stacked in the body of the component. Now, collector electrodes 6, 6' are generated at two opposite sides of the body of the component, and these are respectively in electrical contact with every other electrode layer 5. Furthermore, for example, a metallization, usually with silver, can at first be generated on the ceramic material, for example, by de-energized deposition. The latter can subsequently be reinforced by galvanic processes, such as for example by the application of a sequence of layers Ag/Ni/Sn. This enhances the possibility of soldering on printed boards. Nevertheless, other possibilities of metallization or generation of the collector electrodes 6, 6', respectively, are also suitable, such as sputtering.

The component 8 represented in FIG. 2 has ceramic layers as end layers on both of the main surfaces. Here, for example, an un-imprinted green sheet 1 may be installed in the stack of sheets as the top layer before sintering, so that the stack does not end with an electrode layer 2. For components subject to particular mechanical stress, it is also possible to design the top and bottom ceramic layers in the stack with greater thickness than the remaining ceramic layers 4 in the stack. Here, during stacking of the stack of sheets, several non-imprinted green sheets 1 may be installed as bottom and top layers without an electrode layer and then be compressed and sintered together with the remaining stack of green sheets.

Figure 3:
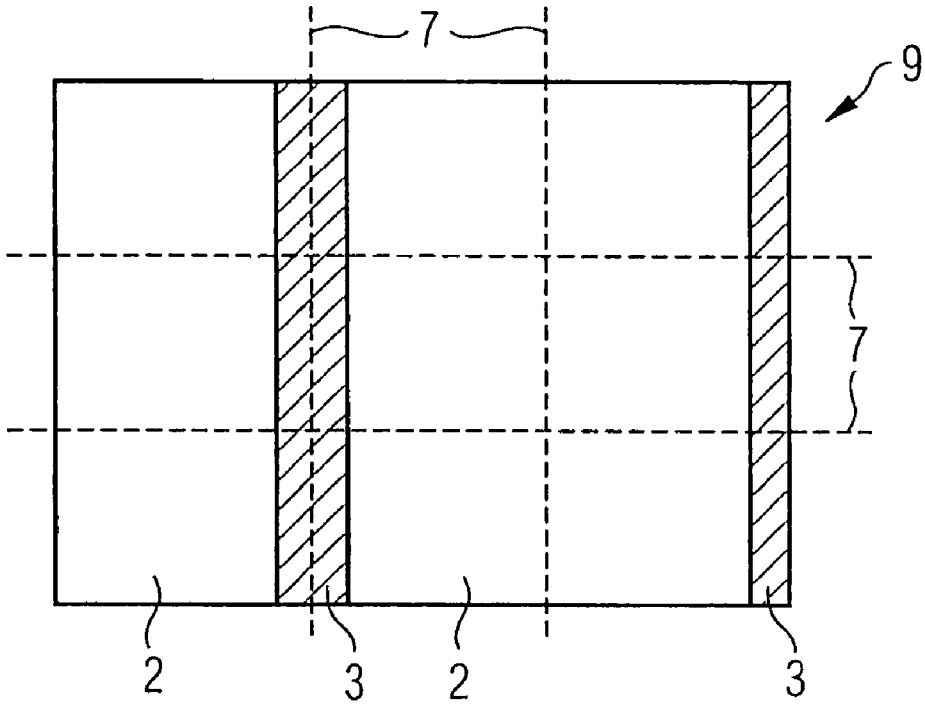
FIG. 3 shows a ceramic green sheet that can be divided into several components, with active and passive areas, in a top view.

FIG. 3 shows a green sheet imprinted with an electrode pattern 2 that makes a division into several components, each with a smaller base, possible. The passive areas 3 not imprinted with electrode paste are configured in such a way that by alternately stacking first and second green sheets, the alternating offset of the electrodes in the stack can be adjusted as suitable for contacting. This can be achieved if the first and second green sheets are rotated by, for example, 180° in relation to one another or if in general first and second green sheets are arranged as offset in relation to one another in the electrode pattern. The cutting lines 7 along, which the green sheet or the layer stack produced therefrom, respectively, can be divided into individual components are shown as interrupted lines. However, it is also possible to have electrode patterns in which the cuts for the division into individual components are laid out in such a way that no electrode layer needs to be cut through. Every other electrode layer however can then be contacted from the edge of the stack. For this purpose, if necessary, the stacks are ground after being divided into individual components and after sintering but before attachment of the collector electrodes 6, 6', in order to expose the contacting electrode layers.

Figure 4:
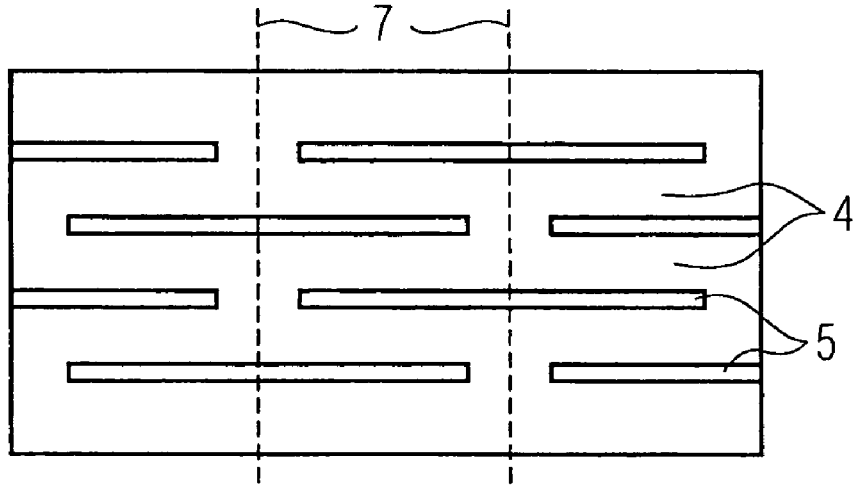
FIG. 4 shows a cross section of a stack of layers of ceramic green sheets.

FIG. 4 shows a schematic cross section of a stack of layers produced in this manner. It becomes evident that components are formed of which each has the desired offset of the electrodes 4 when the layer stack is divided into individual components along the cutting lines 7. The division of a stack of sheets of this type comprising several component base sizes into individual sheet stacks of the desired component base size may occur after compressing the stacks of sheets, for example, by cutting or punching. Subsequently, the stacks of sheets are sintered. However, it is also possible to first sinter the stack of sheets comprising several component base sizes and only then to divide it into individual components by sawing the sintered ceramic pieces. Finally, collector electrodes 6 are again applied.

A PTC component as described herein may include a barium titanate ceramic material of the general composition (Ba, Ca, Sr, Pb)$TiO_3$ which is doped with donators and/or acceptors, for example with manganese and yttrium.

The component may, for example, comprise 5 to 20 or more ceramic layers along with the respective electrode layers, but has at least two internal electrode layers. The ceramic layers normally each have a thickness of 30 through 200 μm. They may, however, also be of greater or smaller layer thickness.

The exterior dimension of a PTC component in the multilayer design may vary, but for components that can be processed within the framework of SMD it is normally in the range of only few millimeters. A suitable size is, for example, the size of design 2220 known from capacitors. Geometries and component tolerances in this respect result from the CECC 32101-801 standard or from other standards. Nevertheless, the PTC component may also be still smaller.

FIGS. 5A through D each show an equal temperature profile combined with differing oxygen profiles. The temperature evolution is indicated by the continuous curve G. The area I between the times 0 and 260 minutes is the area of binder removal. The temperature rises evenly from 20° C. to 500° C. In this time range, the oxygen content is 2 vol. %.

Adjacent to the area I lies area II, beginning at the time of 280 minutes and ending at the time of 500 minutes. In this area II, the layer stack is sintered. In this process, the temperature is, starting from the binder removal end temperature of 500° C., further increased until it reaches a value of 1200° C., after which it is again reduced.

Figure 5A:
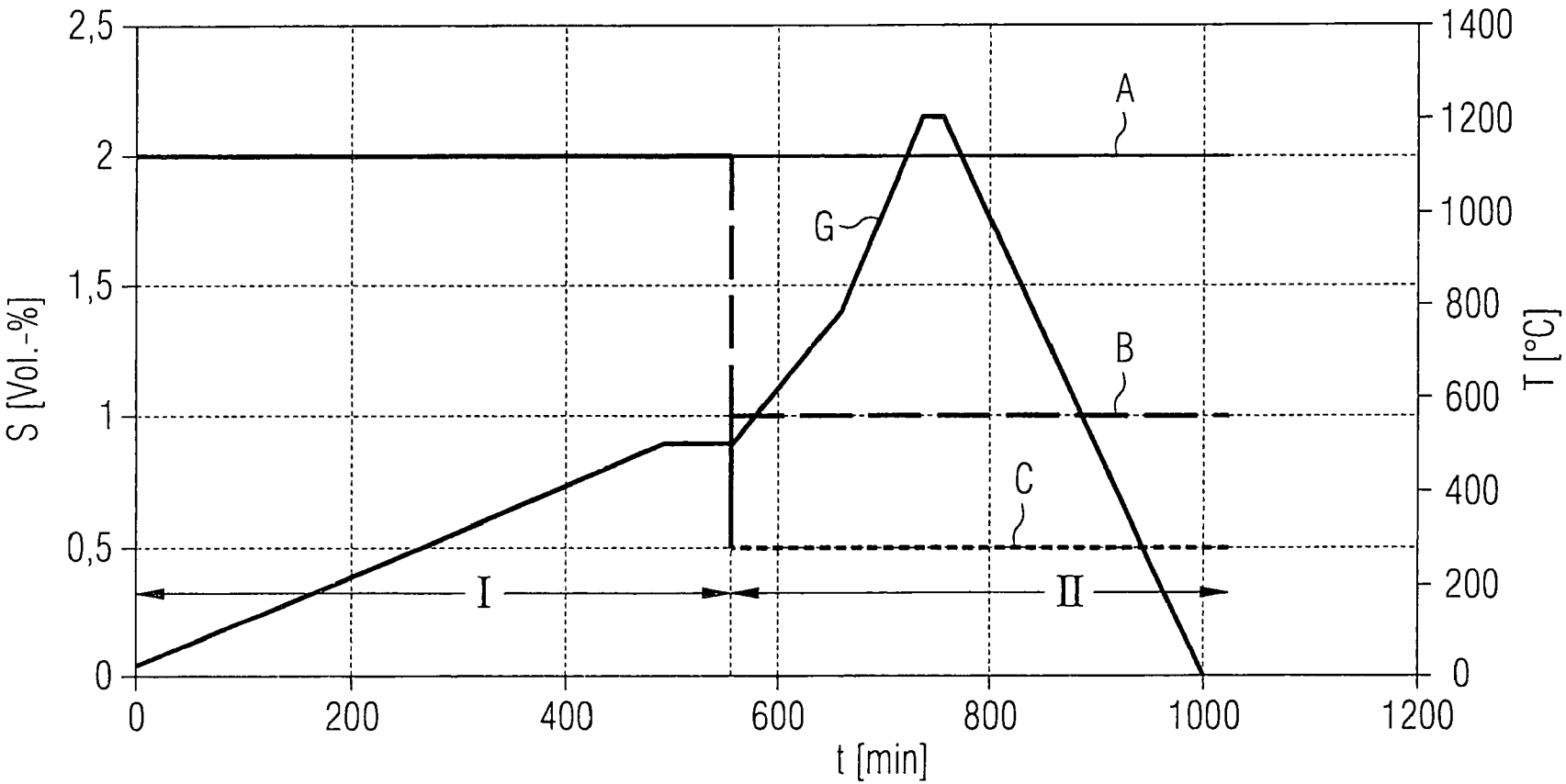
FIG. 5A each show a temperature/oxygen profile for binder removal or for sintering, through D respectively, of a stack of layers.
Figure 5B:
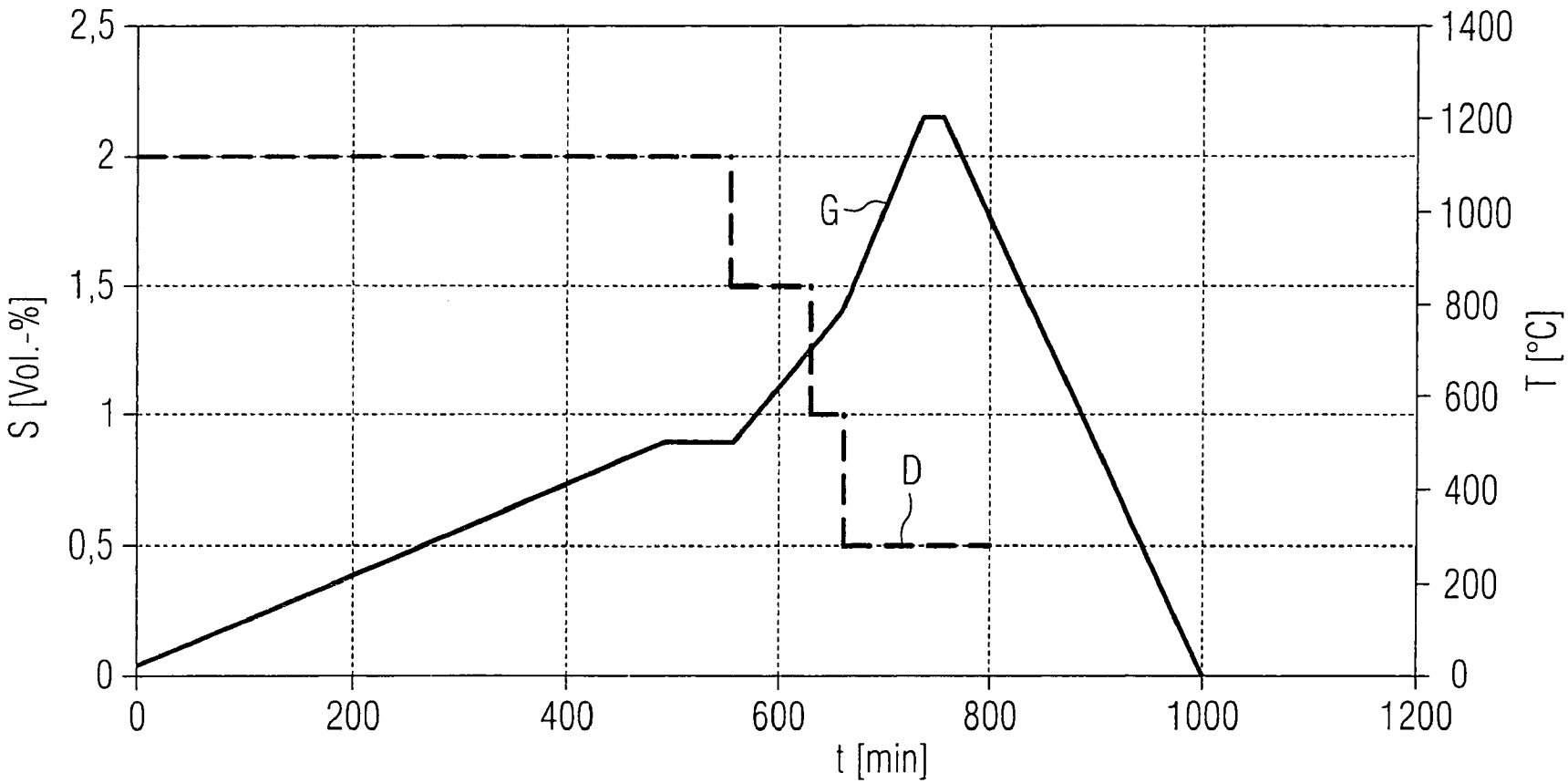
Figure 5C:
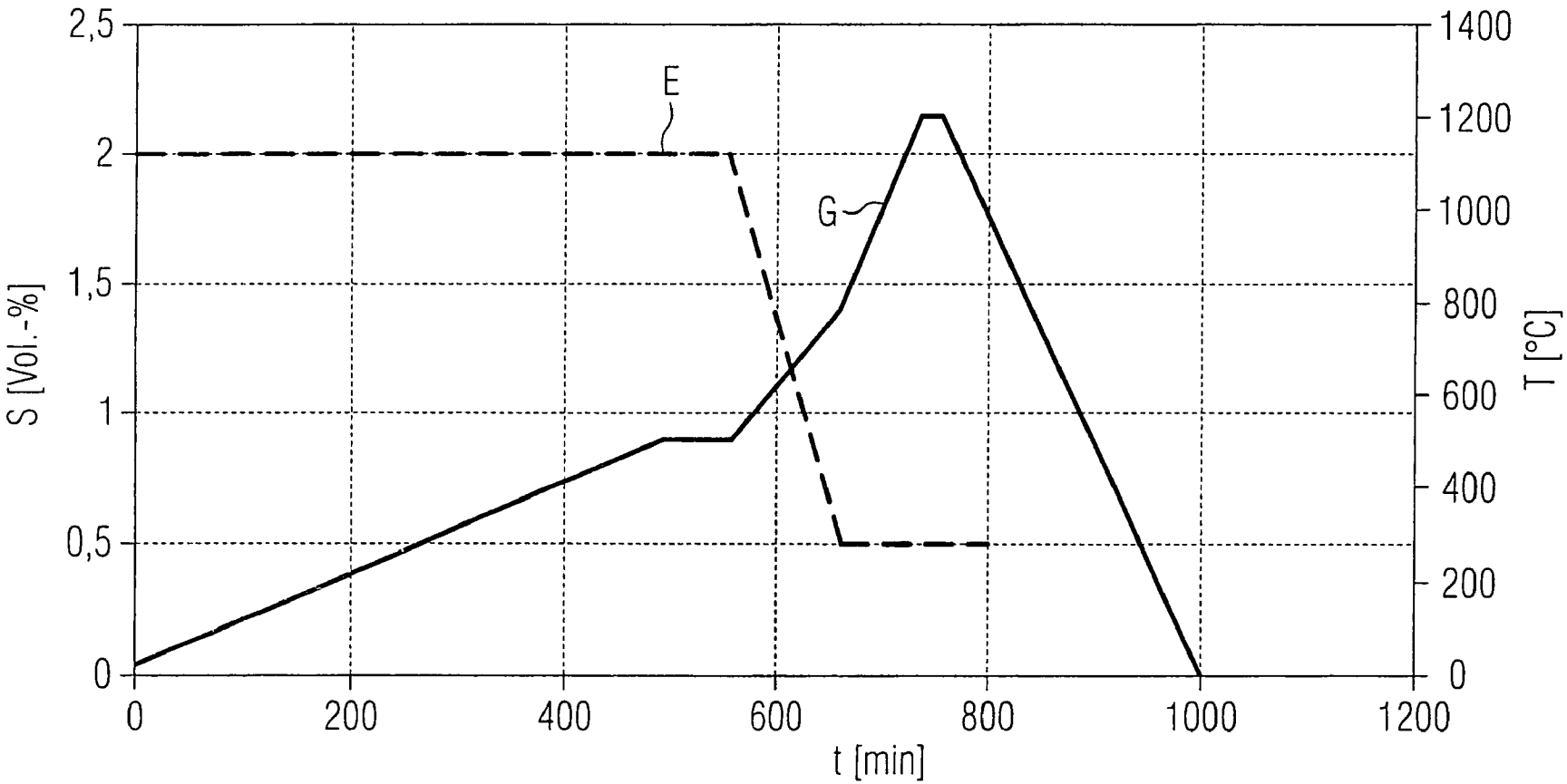
Figure 5D:
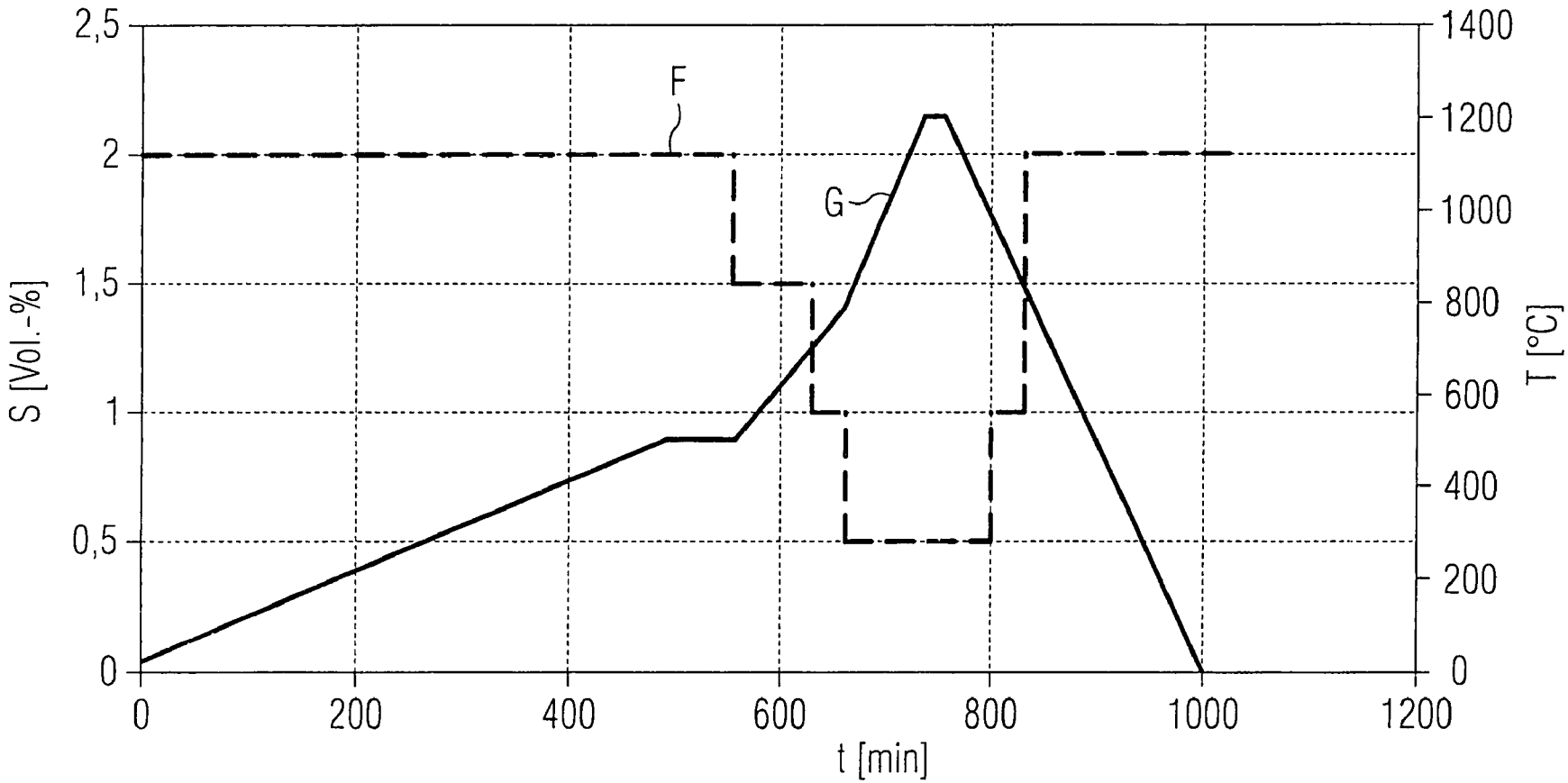

During sintering (area II), the oxygen content may be kept either at 2 vol. %, i.e., at the value of binder removal (curve A in FIG. 5A), or the oxygen content is, after binder removal terminated, decreased to a lower value, such as 1 vol. % (curve B in FIG. 5A) or 0.5 vol. % (curve C in FIG. 5A).

Another possibility is the step-by-step decrease of the oxygen content in the direction opposite to the rising temperature (see curve D in FIG. 5 B). In FIG. 5 C, another variant is shown wherein the oxygen content according to curve E is continuously decreased during sintering down to a value of 0.5 vol. %.

Furthermore, it may be, advantageous, as shown in FIG. 5 D, curve F, to decrease the oxygen content with rising temperature and, after exceeding the maximum temperature of 1200° C., to allow it to increase again step by step. This has the advantage that more oxygen will again be available for the ceramic material when temperatures are lower than the maximum sintering temperature, which improves the properties of the ceramic. This promotes better formation of the grain boundary-active layers of the PTC ceramic material.

Furthermore, it is advantageous if the processes of binder removal and sintering are performed immediately one after the other, without lowering the temperature to ambient temperature or below the maximum binder removal temperature of 500° C. in between. This results in an shortening of the processing time as well as in lower oxidation of tungsten.

The processes of binder removal and sintering may be performed in an atmosphere representing a mixture of nitrogen or noble gas or another inert gas with air or oxygen. For example, nitrogen and air may be mixed in such a way that it leads to an oxygen content of 2 vol. % in the atmosphere. Up to a temperature of 500° C., the layer stacks are freed of binder, and sintering is performed in the same atmosphere. Barium titanate ceramic materials, for example, may be used; sintering is performed at the temperatures normally used for this process.

In Table 1 below, component resistances of PTC components manufactured with the method in design 1210 with 23 electrodes are shown as a function of the oxygen content during sintering and compared with sintering in air.

TABLE 1

| Oxygen content in vol. % | Component resistance in Ω |
|---|---|
| 21 (air) | 40 |
| 7 | 25 |
| 1 | 9 |
| 0.5 | 2.5 |

This makes clear how the resistance of the component can be decreased by reducing the oxygen content. This is the consequence of decreased oxidation of the metallic material contained in the internal electrodes.

By using the method described herein, it is possible to manufacture PTC components with small volume and with simultaneously low electrical resistance.

Table 2 below shows PTC component resistances as a function of the volume of the PTC component.

TABLE 2

| Design | Length in mm | Width in mm | Height in mm | Obtainable component resistance in Ohm | Volume in $mm^3$ | V · R in Ohm · $mm^3$ |
|---|---|---|---|---|---|---|
| 0805 | 1.25 | 1.0 | 2.0 | <100 | 2.5 | <250 |
| 0805 | 1.25 | 1.7 | 2.0 | <100 | 4.25 | <425 |
| 1206 | 1.6 | 1.0 | 3.2 | <50 | 5.12 | <256 |
| 1206 | 1.6 | 1.7 | 3.2 | <50 | 8.7 | <435 |
| 1210 | 2.5 | 1.0 | 3.2 | <30 | 8.0 | <240 |
| 1210 | 2.5 | 2.0 | 3.2 | <30 | 16.0 | <480 |
| 1812 | 3.2 | 1.0 | 4.5 | <20 | 14.4 | <288 |
| 1812 | 3.2 | 2.0 | 4.5 | <20 | 28.8 | <576 |
| 2220 | 5.0 | 1.0 | 5.7 | <10 | 28.5 | <285 |
| 2220 | 5.0 | 2.0 | 5.7 | <10 | 57.0 | <570 |

The invention claimed is:

1. A method of manufacturing an electrical component having a positive temperature coefficient, the electrical component comprising:

(a) a base comprised of ceramic layers and electrode layers, the electrode layers being among the ceramic layers, the ceramic layers comprising a ceramic material that has a positive temperature coefficient in at least one part of an R/T characteristic curve, and (b) a first collector electrode attached to a first side of the electrical component and a second collector electrode attached to a second side of the electrical component, wherein the first collector electrode and the second collector electrode contact alternate electrode layers, wherein the electrical component has a volume V and a resistance R, the resistance R being measured between collector electrodes at a temperature of between 0° C. and 40° C., and wherein $V \cdot R < 600\Omega \cdot mm^3$, wherein the method comprises:

forming the base using ceramic green sheets interspersed with the electrode layers, the ceramic green sheets comprising the ceramic layers that comprise the ceramic material that has the positive temperature coefficient in the at least one part of the R/T characteristic curve; and removing a binder from, and sintering, the base in an environment having an oxygen content, wherein the oxygen content of the environment is lower than an oxygen content of air;

wherein the oxygen content of the environment is less than 8 vol. %.

2. The method of claim 1, wherein removing the binder is performed at a temperature of <600° C.

3. The method of claim 1, wherein sintering is performed in a temperature interval of between 1000° C. and 1200° C.

4. The method of claim 1, further comprising, after removing the binder, keeping a temperature of the base at a value that corresponds to a binder removing temperature at least until sintering is completed.

5. The method of claim 1, wherein removing the binder is performed in the environment with an oxygen content of between 0.5 and <8 vol. %.

6. The method of claim 1, wherein sintering is performed in the environment with an oxygen content that corresponds to an oxygen content that is present during removal of the binder.

7. The method of claim 1, wherein sintering is performed in the environment with an oxygen content of between 0.1 and 5 vol. %.

8. The method of claim 1, wherein the oxygen content of the environment is decreased after the binder is removed.

9. The method of claim 1, wherein the oxygen content of the environment is reduced continuously after the binder is removed.

10. The method of claim 1, wherein after the binder is removed, the oxygen content of the environment decreases with increasing temperature.

11. The method of claim 1, wherein the oxygen content of the environment increases after a maximum sintering temperature is exceeded.

12. A method of manufacturing an electrical component having a positive temperature coefficient, the electrical component comprising:

(a) a base comprised of ceramic layers and electrode layers, the electrode layers being among the ceramic layers, the ceramic layers comprising a ceramic material that has a positive temperature coefficient in at least one part of an R/T characteristic curve, and (b) a first collector electrode attached to a first side of the electrical component and a second collector electrode attached to a second side of the electrical component, wherein the first collector electrode and the second collector electrode contact alternate electrode layers, wherein the electrical component has a volume V and a resistance R, the resistance R being measured between collector electrodes at a temperature of between 0° C. and 40° C., and wherein $V \cdot R < 600\Omega \cdot mm^3$, wherein the method comprises:

forming the base using ceramic green sheets interspersed with the electrode layers, the ceramic green sheets comprising the ceramic layers that comprise the ceramic material that has the positive temperature coefficient in the at least one part of the R/T characteristic curve; and removing a binder from, and sintering, the base in an environment having an oxygen content, wherein the oxygen content of the environment is lower than an oxygen content of air;

wherein removing the binder is performed at a temperature of <600° C.

13. A method of manufacturing an electrical component having a positive temperature coefficient, the electrical component comprising:

(a) a base comprised of ceramic layers and electrode layers, the electrode layers being among the ceramic layers, the ceramic layers comprising a ceramic material that has a positive temperature coefficient in at least one part of an R/T characteristic curve, and (b) a first collector electrode attached to a first side of the electrical component and a second collector electrode attached to a second side of the electrical component, wherein the first collector electrode and the second collector electrode contact alternate electrode layers, wherein the electrical component has a volume V and a resistance R, the resistance R being measured between collector electrodes at a temperature of between 0° C. and 40° C., and wherein $V \cdot R < 600\Omega \cdot mm^3$, wherein the method comprises:

forming the base using ceramic green sheets interspersed with the electrode layers, the ceramic green sheets comprising the ceramic layers that comprise the ceramic material that has the positive temperature coefficient in the at least one part of the R/T characteristic curve; and removing a binder from, and sintering, the base in an environment having an oxygen content, wherein the oxygen content of the environment is lower than an oxygen content of air;

wherein removing the binder is performed in the environment with an oxygen content of between 0.5 and <8 vol. %.

14. A method of manufacturing an electrical component having a positive temperature coefficient, the electrical component comprising:

(a) a base comprised of ceramic layers and electrode layers, the electrode layers being among the ceramic layers, the ceramic layers comprising a ceramic material that has a positive temperature coefficient in at least one part of an R/T characteristic curve, and (b) a first collector electrode attached to a first side of the electrical component and a second collector electrode attached to a second side of the electrical component, wherein the first collector electrode and the second collector electrode contact alternate electrode layers, wherein the electrical component has a volume V and a resistance R, the resistance R being measured between collector electrodes at a temperature of between 0° C. and 40° C., and wherein $V \cdot R < 600\Omega \cdot mm^3$, wherein the method comprises:

forming the base using ceramic green sheets interspersed with the electrode layers, the ceramic green sheets comprising the ceramic layers that comprise the ceramic material that has the positive temperature coefficient in the at least one part of the R/T characteristic curve; and removing a binder from, and sintering, the base in an environment having an oxygen content, wherein the oxygen content of the environment is lower than an oxygen content of air;

wherein sintering is performed in the environment with an oxygen content of between 0.1 and 5 vol. %.

* * * * *